US008093993B2

(12) United States Patent
Chou et al.

(10) Patent No.: US 8,093,993 B2
(45) Date of Patent: Jan. 10, 2012

(54) IDENTIFICATION TAG INFORMATION REMINDER SYSTEM AND METHOD AND PORTABLE IDENTIFICATION TAG INFORMATION REMINDER DEVICE USING THE METHOD

(75) Inventors: Feng-Jian Chou, Hsinchu Hsien (TW); Meng-Shu Lee, Hsinchu Hsien (TW)

(73) Assignee: MStar Semiconductor, Inc., Hsinchu Hsien (TW)

( * ) Notice: Subject to any disclaimer, the term of this patent is extended or adjusted under 35 U.S.C. 154(b) by 408 days.

(21) Appl. No.: 12/472,795

(22) Filed: May 27, 2009

(65) Prior Publication Data

US 2010/0102953 A1 Apr. 29, 2010

(30) Foreign Application Priority Data

Oct. 29, 2008 (TW) ..... 97141655 A

(51) Int. Cl.
*G08B 1/00* (2006.01)

(52) U.S. Cl. ..... 340/309.7; 340/539.11; 340/572.1; 340/572.7; 340/573.1; 340/573.4; 340/568.1; 340/7.3; 340/7.55; 340/10.42

(58) Field of Classification Search ..... 340/307.9, 340/539.11, 572.1, 572.7, 573.1, 573.4, 10.42, 340/568.1, 7.3, 7.55
See application file for complete search history.

(56) References Cited

U.S. PATENT DOCUMENTS 7,880,613 B1 * 2/2011 Maeng ..... 340/572.1
2007/0037614 A1 * 2/2007 Rosenberg ..... 455/575.1

* cited by examiner

*Primary Examiner* — Tai T Nguyen
(74) *Attorney, Agent, or Firm* — WPAT., P.C.; Justin King

(57) ABSTRACT

An identification tag information reminder system and a method thereof are provided. The system comprises an identification tag, for storing a tag identification code, an identification condition data and a reminder message corresponding to the identification condition data; and a portable device, comprising a memory, for storing a plurality of predetermined reminder conditions; an identification tag access module, for accessing the tag identification code, the identification condition data and the reminder message corresponding to the identification condition data of the identification tag; a processing module, for comparing the predetermined reminder condition with the tag identification code and the identification condition data to generate a comparison result; and an indicating module, for outputting the reminder message according to the comparison result.

14 Claims, 8 Drawing Sheets

IDENTIFICATION TAG INFORMATION REMINDER SYSTEM AND METHOD AND PORTABLE IDENTIFICATION TAG INFORMATION REMINDER DEVICE USING THE METHOD

CROSS REFERENCE TO RELATED PATENT APPLICATION

This patent application is based on a Taiwan, R.O.C. patent application No. 97141655 filed on Oct. 29, 2008.

FIELD OF THE INVENTION

The present invention relates to an identification tag information reminder system and a method thereof, and more particularly, to a device having data access capability and information reminder capabilities of the radio frequency identification (RFID) technology and a method thereof.

BACKGROUND OF THE INVENTION

As electronic digital technology develops continuously, various electronic devices or electronic products with different application functions are frequently applied in the daily life of the modern people. For example, development of mobile computing technology have brought the emergence of portable electronic devices or mobile computing products, such as cell phones, mobile phones, person digital assistants (PDA), and notebook computers. The devices or products provide rather great user convenience and practicability.

In addition, as integrated circuit design, semiconductor fabrication and radio communication technology evolve progressively in recent years, RFID technology becomes more and more mature day by day. RFID electronic tags using the RFID technology are gradually and widely applied to various types of products. For example, smart identification cards, access control management systems of buildings, shopping check-out systems, storage managements, goods distribution, circulation and tracking systems, and various types of identification cards are applications of the RFID technology. Furthermore, the RFID electronic tag technology can provide more custom-made and convenient service according to habits or behaviors of customers and consumers.

The RFID electronic tag not only has better recording data capacity and data access efficiency than those of a conventional two-dimensional bar code tag, it also has a much more powerful extended function. Generally speaking, a user stores and records a data, of an object or a product to which an RFID electronic tag is to be attached, such as identity information, a products number, an identification code or related setting information, into a small chip of the RFID electronic tag. After being verified by a related verification procedure, the data received and transmitted via radio signals is accessed by a reader using the same RFID technology.

The data is transmitted between the RFID electronic tag and the reader via radio signals, in the form of a non-contact reading identification technology that determines an effective access range for accessing the RFID electronic tag according to the power of the signals. Compared to the two-dimensional bar code technology, the RFID technology can access a result more quickly by transmitting and receiving the radio signals. For example, with respect to products, a manager can access data of the RFID electronic tags of all objects within a specific range in one batch rather than accessing or scanning the RFID electronic tags one after another, and hence access time of the tags is effectively reduced. Moreover, as far as the current RFID technology is concerned, an electronic tag produced accordingly can provide customized services upon different user applications. For example, the user can obtain a specific identification function via an access device having a specific access procedure and a tag having specific information.

The RFID technology has become increasingly mature and it is now common to use mobile computing devices. Therefore, it is an important topic of the technology industry to further develop and improve applications of the RFID technology that integrates with the mobile computing devices to provide greater convenience and more customized functions.

SUMMARY OF THE INVENTION

An objective of the present invention is to provide an identification tag information reminder system and a method thereof, so as to integrate a data access function of the RFID technology with an indication function of a portable device. Consequently, a user can obtain a more convenient and more effective information reminder related to tasks or a schedule in the daily life or the environment.

An identification tag information reminder system is provided according to the present invention. The identification tag information reminder system, comprises an identification tag, for storing a tag identification code, an identification condition data and a reminder message corresponding to the identification condition data; and a portable device, comprising a memory, for storing a plurality of predetermined reminder conditions; an identification tag access module, for accessing the tag identification code, the identification condition data and the reminder message corresponding to the identification condition data of the identification tag; a processing module, for comparing the predetermined reminder condition with the tag identification code and the identification condition data to generate a comparison result; and an indicating module, for outputting the reminder message according to the comparison result.

An identification tag information reminder method is provided according to an aspect of the present invention. The method applied to an identification tag information reminder system comprises a portable device and an identification tag, wherein the identification tag stores a tag identification code, an identification condition data and a reminder message corresponding to the identification condition data, the identification tag information reminder method comprising setting the predetermined reminder condition into the portable device; accessing the tag identification code, the identification condition data and the reminder message corresponding to the identification condition data of the identification tag; comparing the tag identification code and the identification condition data with the predetermined reminder condition to generate a comparison result; and outputting the reminder message according to the comparison result.

A portable identification tag information reminder device is provided according to another aspect of the present invention. The portable identification tag information reminder device, for accessing an identification tag, comprises a memory, for storing a predetermined reminder condition and a reminder message corresponding to the predetermined reminder condition; an identification tag access module, for accessing a tag identification code of the identification tag; a processing module, for comparing the tag identification code with the predetermined reminder condition to generate a comparison result; and an indicating module, for outputting the reminder message according to the comparison result.

A portable identification tag information reminder device is provided according to another aspect of the present invention. The portable identification tag information reminder device, for accessing an identification tag, comprises a memory, for storing a predetermined reminder condition; an identification tag access module, for accessing a tag identification code, a identification condition data and a reminder message corresponding to the identification condition data of the identification tag; a processing module, for comparing the tag identification code and the identification condition data with the predetermined reminder condition to generate a comparison result; and an indicating module, for outputting the reminder message according to the comparison result.

BRIEF DESCRIPTION OF THE DRAWINGS

The advantages and spirit related to the present invention can be further understood via the following detailed description and drawings.

FIG. 2 (*b*) is a data format of an identification tag according to the present invention.

FIG. 6 (*b*) is a flow chart of operating an encrypted identification tag via an identification tag information reminder method comprising a decryption process.

DETAILED DESCRIPTION OF THE PREFERRED EMBODIMENT

A traditional event or schedule reminder device applies the time as a reminder condition of an event or a schedule via a reservation function and a timing function of the device. For example, a clock function of a mobile device, such as a mobile phone, a personal digital assistant (PDA) or a notebook computer, is applied to generate an alarm, a sound or a vibration function within a predetermined time, or is associated with an image display function of related pictures to remind a user of a certain event or schedule. However, a reminder method using the time as a reminder condition does not generate a reminder until a set time is reached, and that shall cause operational limitations. For example, a user wishes to remind oneself to bring certain things when leaving the office, but is not sure when one will leave. At this point, the time is not a trigger condition of the reminder; the reminder is in fact related to a geographic condition. Therefore, a conventional reminder design of a clock function can not satisfy the demand of the user.

Figure 1:
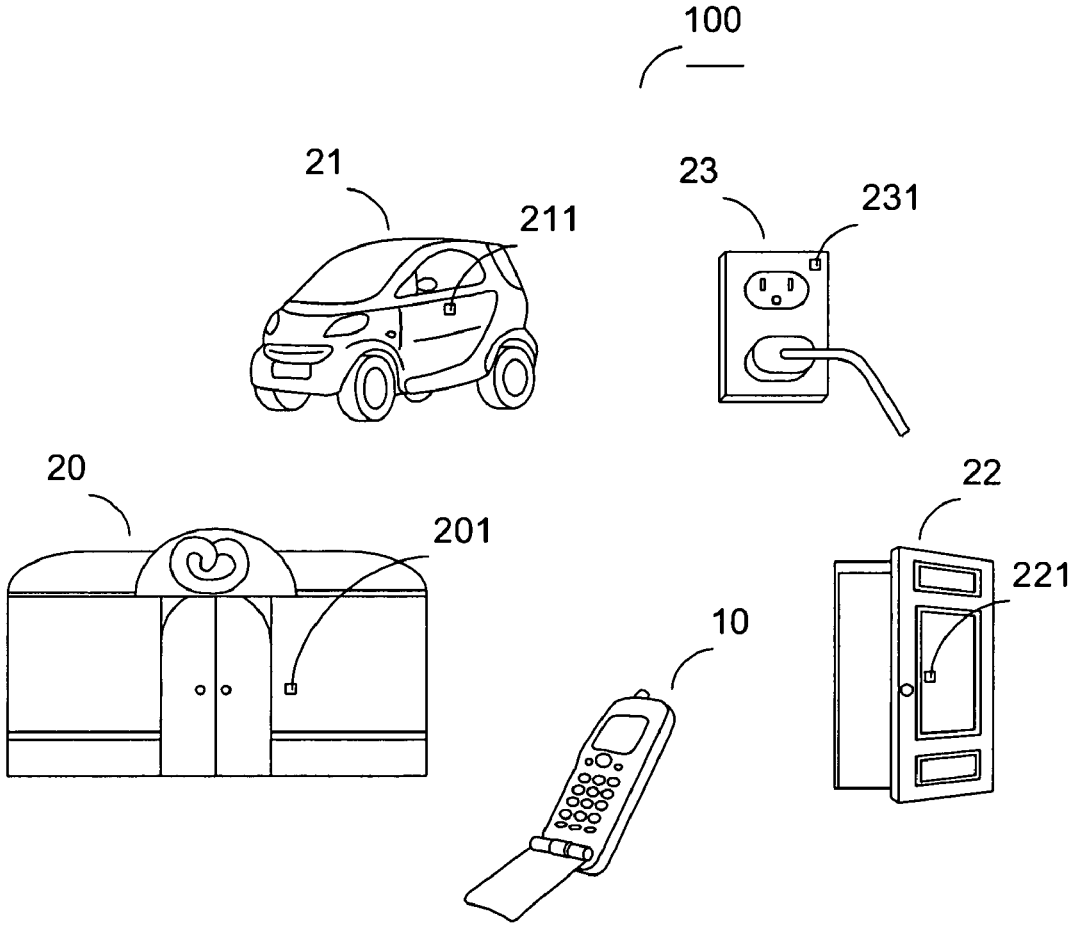
FIG. 1 is a schematic diagram of an identification tag information reminder system 100 in accordance with an embodiment of the present invention.

Refer to FIG. 1 showing a schematic diagram of an identification tag information reminder system 100, which comprises a portable device and a plurality of identification tags. The portable device, carried by a user, can be a mobile phone 10 as shown in FIG. 1. The plurality of identification tags are at least attached to locations such as a store 20, a private vehicle 21, a house entrance 22, a power socket 23 and so on. The identification tag information reminder system 100 sets at least one of identification tags 201 to 231 manufactured using the RFID technology on each of the locations, so as to provide an information reminder function according to the present invention. The portable device of the mobile phone 10 comprises an RFID tag reader, which identifies and accesses the foregoing identification tags. In addition, the mobile phone 10 serving as the portable device according to the present also comprises a portable identification tag information reminder device, which performs the foregoing identification function to further accomplish the reminder and notification function.

The identification tag information reminder system 100 according to the present invention integrates electronic tags of the RFID technology with a portable device capable of accessing the electronic tags. After defining related reminder conditions and information in advance using the RFID technology, a reminder of an event or a schedule is indicated according to geographic and time conditions in an environment where the system is provided. In a preferred embodiment, product information is directly recorded into RFID identification tags attached to the products when the products are exhibited in a store or a market, and is also maintained in a product catalog. A user enters the product information from the product catalog into the mobile phone 10 comprising a reminder device of an RFID reader. When the user passes by the products while walking in the store or market, the mobile phone 10 then reminds the user to buy the products. In another preferred embodiment, a user inputs content and related information of a reminder into an RFID identification tag and the mobile phone 10 comprising an RFID reminder device, and sets the RFID identification tag on a predetermined reminder location. When the user passes by the predetermined location, the mobile phone 10 shall access the reminder message to remind the user.

Figure 2A:
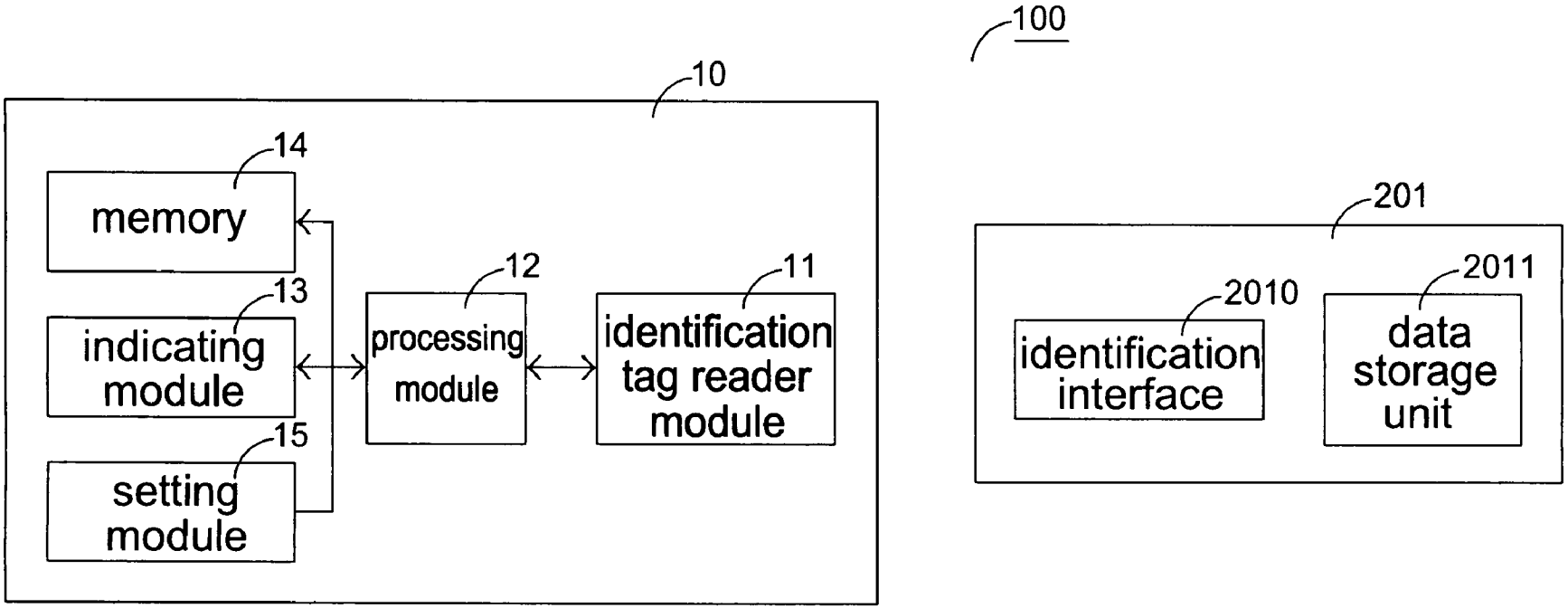
FIG. 2 (*a*) is a functional block diagram of the identification tag information reminder system 100 in accordance with an embodiment of the present invention.
Figure 2B:
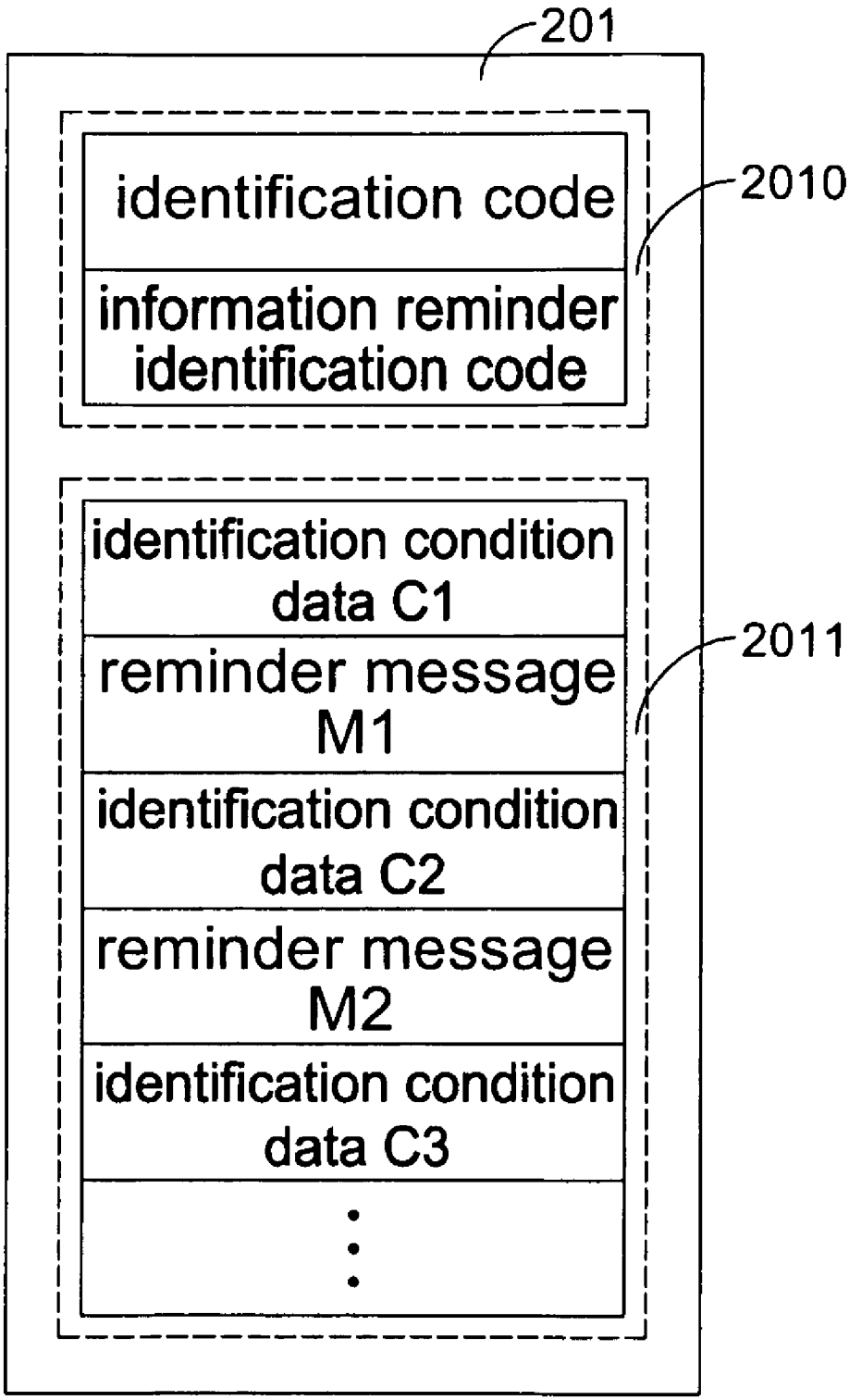

Refer to FIG. 2 (*a*) showing a functional block diagram of the identification tag information reminder system 100 in accordance with an embodiment of the present invention. As mentioned above, the mobile phone 10 automatically accesses and identifies the foregoing identification tag 201 on a corresponding location using the RFID technology. The mobile phone 10 comprises an identification tag reader module 11, a processing module 12, an indicating module 13, a memory 14, and a setting module 15. The identification tag 201 comprises an identification interface 2010, and a data storage unit 2011. The data storage unit 201 stores various types of corresponding identification condition data and reminder messages in an itemized manner. The identification interface 2010 provides a verification procedure to the identification tag reader module 11 of the mobile phone 10. An objective of the verification procedure is to determine whether to allow the mobile phone 10 to further access the reminder information.

Refer to FIG. 2 (*b*) showing a data format of an identification tag according to the present invention. Taking the identification tag 201 as an example, a unique tag identification code, contained in the identification interface 2010 of the identification tag 201, for distinguishing from other tags, is designed to be 8-bit. An information reminder identification code, needed by an information reminder method, also contained in the identification interface 2010 of the identification tag 201, is designed to be 4-bit to indicate a function of the identification tag 201. The information storage unit 2011 stores various groups of identification condition data C1 to C3 and a plurality of reminder messages M1 to M2 corresponding to the identification condition data C1 to C3. The number of the identification condition data and the reminder message to be stored is dependent on the size of the storage unit and purposes of application.

As mentioned above, the reminder message contained in the identification tag according to the present invention comprises a public reminder message when an identification tag is accessed and identified in a public system, i.e., the public reminder message without encryption is provided. For example, the RFID identification tags of the products of the foregoing store 20 or market are not encrypted. The reminder message according to the present invention can be encrypted to satisfy personal needs or to be provided to specific individuals. For example, the user sets one or a plurality of identification tags having an information reminder function at the locations of the private vehicle 21, the house entrance 22 or the power socket 23. Each of the identification tags stores a predetermined identification condition data and a corresponding reminder message. After the mobile phone 10 verifies that the conditions match with the reminder message by performing an access and identification procedure, the mobile phone 10 accesses the corresponding reminder message and reminds the user of the reminder information via a notice in text, sound or images.

In a preferred embodiment, information or data stored in an identification tag attached to a product is set and edited by a manufacturer. In addition, except for a function of accessing data of an RFID identification tag, the mobile phone 10 has functions of setting the data and editing the identification tag. The mobile phone 10 accesses the identification tag via the identification tag reader module 11 and the setting module 15. For example, a user interface, such as a keyboard or a touch screen of the setting module 15, is used for defining the identification tag. Specifically, the user implements the setting module 15 to input and store one or a plurality of predetermined reminder conditions, with respect to various types of identification tags as illustrated in FIG. 1, into the memory 14 of the mobile phone 10. After the identification tag reader module 11 has accessed one of the identification tags, the processing module 12 compares the identification condition data mentioned above with the predetermined reminder conditions of the mobile phone 10, and generates a comparison result. The processing module 12 then determines whether to further output the corresponding reminder message accessed by the identification tag reader module 11.

Figure 3:
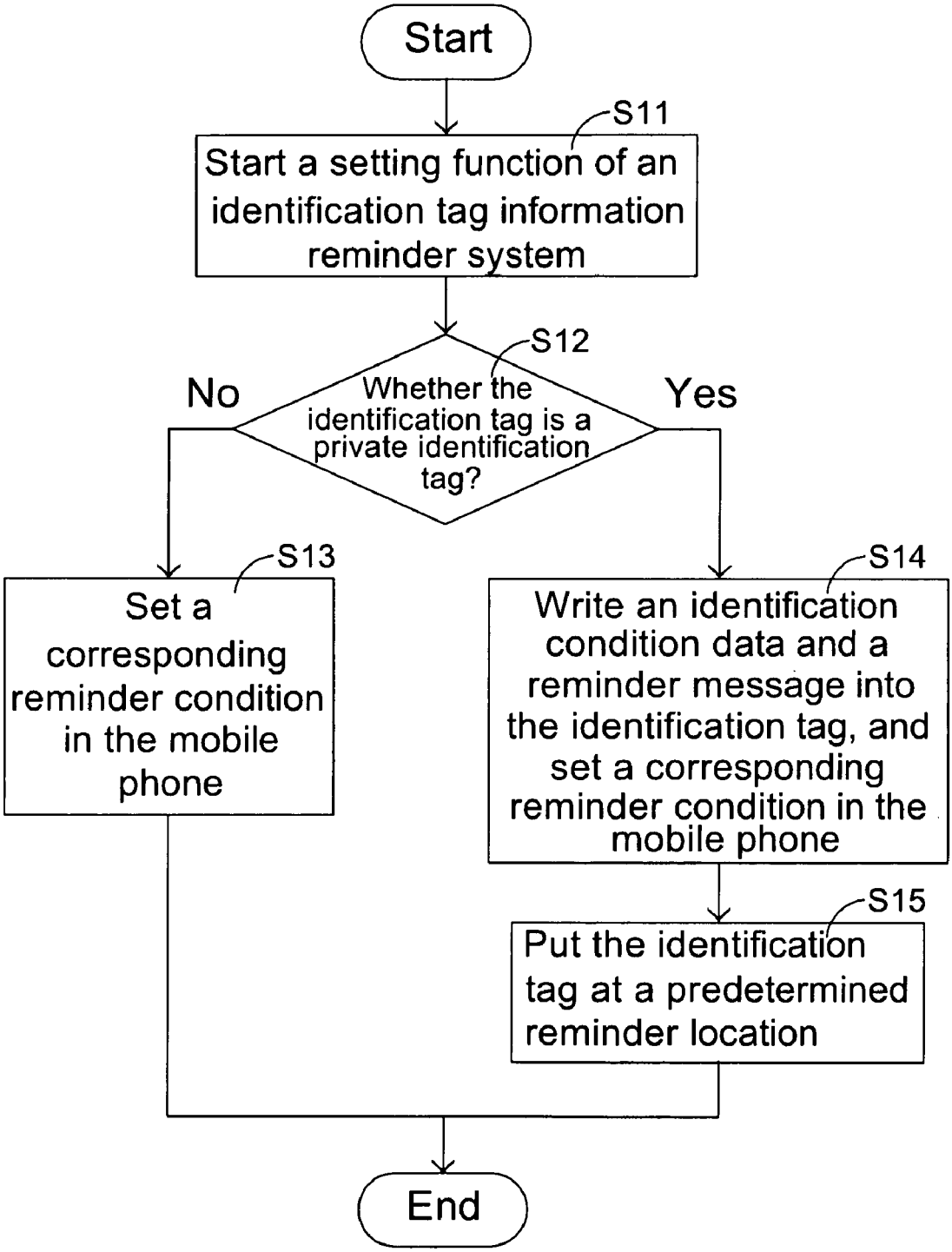
FIG. 3 is a flow chart of setting an identification tag via a mobile phone 10.

FIG. 3 is a flow chart of setting an identification tag via a mobile phone 10. In Step S11, a setting function of an identification tag information reminder system 100 is activated. In Step S12, an application field of the identification tag is determined. When the identification tag is a public identification tag, Step S13 is executed. In Step S13, the user sets a corresponding predetermined reminder condition in the mobile phone 10 with respect to an event that is to be reminded about by the identification tag. When identification tag is a private identification tag, Step S14 is executed. In Step S14, except for setting a corresponding predetermined reminder condition in the mobile phone 10 with respect to an event that is to be reminded about by the identification tag, the user simultaneously writes and stores the corresponding identification condition data and the reminder message into the identification tag. In Step S15, the identification tag is put at a predetermined reminder location.

The identification tag 201 described according to the foregoing embodiment is a public identification tag of a product. The identification condition data, published on information mediums such as the Internet, product catalogs, advertisements, and so on, is provided to be further programmed in the mobile phone 10. More specifically, the user can download the identification information of a product into the mobile phone 10 via the Internet. The identification information of a product catalog or an advertisement is accessed via the identification tag reader module 11 of the mobile phone 10 or a bar code reading module (not illustrated in FIG. 3). Therefore, the user obtains the information of a name of the product and the identification information representing the product. When the user plans to purchase the product, the user can set a predetermined reminder condition corresponding to the identification condition data into the mobile phone 10, and the predetermined reminder condition is stored in the memory 14. Consequently, the predetermined reminder condition is related to the identification condition data of the product and the corresponding reminder message. When the user gets close to the product and the information of the mobile phone 10 matches with the information of the identification tag 201, the reminder message corresponding to the identification condition data is accessed and displayed on the mobile phone 10, so as to remind the user to purchase the product. A detailed reminder method is to be described as below.

Figure 4:
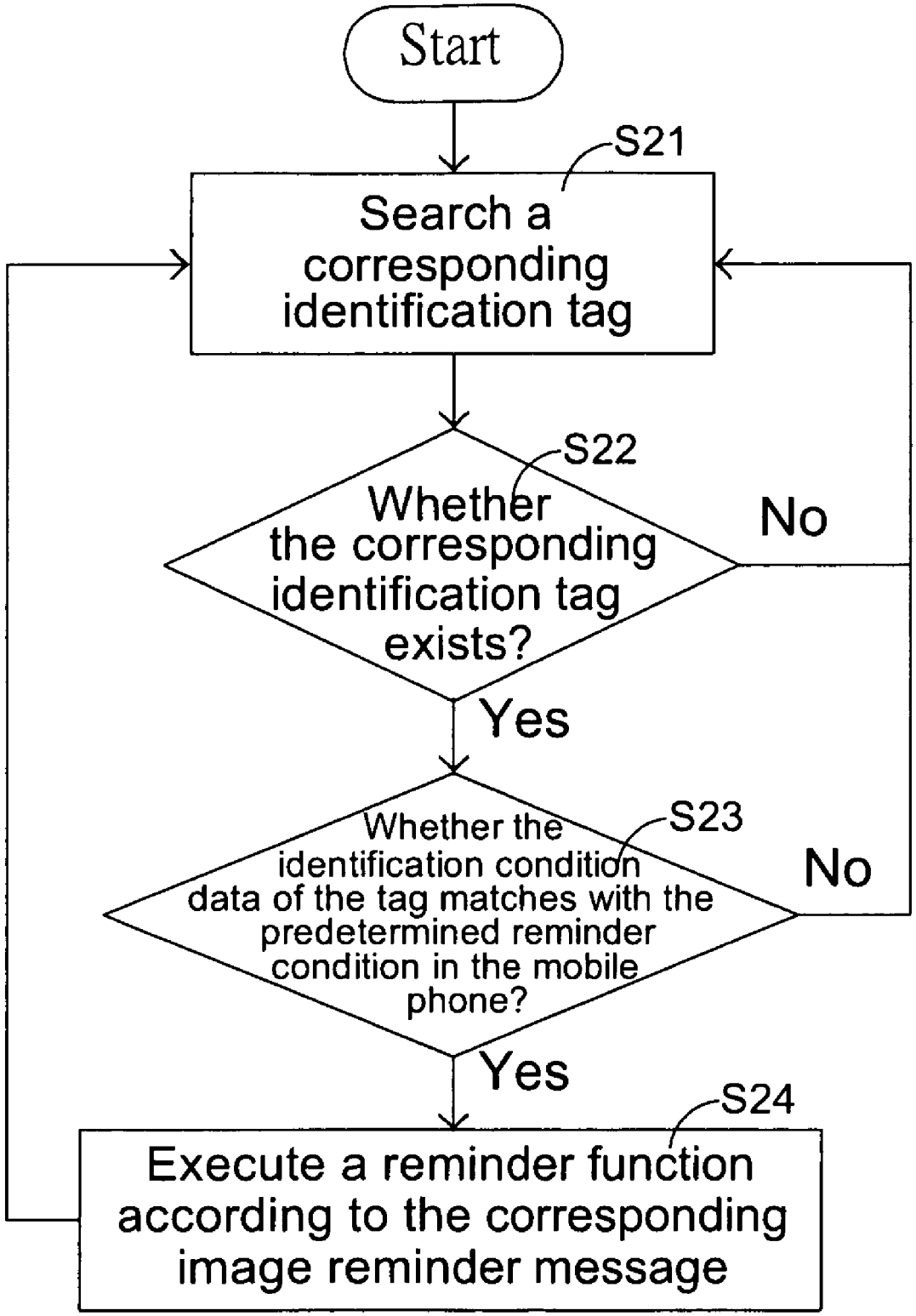
FIG. 4 is a flow chart of an operation of an identification tag information reminder method using the mobile phone 10 in accordance with an aspect of the present invention.

FIG. 4 is a flow chart of an operation of an identification tag information reminder method using the mobile phone 10 in accordance with the foregoing embodiment. The identification tag 201 is attached to a product in the store 20, and the user carrying the mobile phone 10 gets close to the store 20. The mobile phone 10 continuously searches for a corresponding RFID identification tag near the mobile phone 10. However, a search range is determined according to the power intensity of the signal, i.e., a search result is related to a reading range of the mobile phone 10. Scanning using the HF bandwidth can effectively acquire situations within a distance of several centimeters, and scanning using the UHF bandwidth can effectively acquire situations within a distance of several meters as described in Step S21.

According to the identification tag scanning procedure mentioned above, whether the corresponding identification tag exists within a specific range is determined in Step S22. In practice, the RFID identification tag has quite a few types or numbers of application fields. Therefore, the tag identification code and the information reminder identification code stored and recorded in the tag are regarded as a basis of the determinant in Step S22. For example, when the identification tag is scanned, the foregoing information reminder identification code is accessed and determined as a related identification tag, and the information is further identified and accessed. When the information reminder identification code does not match with the predetermined reminder condition defined in the mobile phone 10, the identification tag reader signal keeps on scanning, so as to avoid an access error and reduce unnecessary data process.

Consequently, when the user carrying the mobile phone 10 gets close to a location of a product to be purchased or a product having a tag recording the information reminder identification code, a corresponding tag is found. The identification condition data of the tag is then compared with the predetermined reminder condition defined in the mobile phone 10 to determine whether to output the corresponding reminder message. Note that the user has defined the predetermined reminder condition in advance, i.e., the predetermined reminder condition has recorded the name and data of the product to be purchased. Therefore, when the identification condition data of the tag matches with the predetermined reminder condition defined by the user in Step S23, the reminder message, stored in the tag, corresponding to the identification condition, is accessed, so as to remind the user in a manner as previously defined.

As mentioned above, the identification tag 201 of the product in FIG. 2 (*b*) stores the identification condition data C1, which represents the name or identification content of the product. In addition, the identification condition data C1 is corresponding to one or a plurality of reminder messages. For example, one of the plurality of reminder messages M1 is an image reminder message, content of which is a name or a picture of the product, and more practically, is a text reminder, such as "please remember to purchase the product". A reminder function is operated via a display unit in the indicating module 13, such as a screen of the mobile phone 10. An image message is displayed on the screen according to the corresponding image reminder message. Consequently, in Step S24, a reminder of an automatic identification function is provided when the user gets close to the product or the store 20, so that the user shall not forget a purchase plan as arranged in advance.

Furthermore, reminders in other means may be used to assist in providing real-time reminders to the user. For instance, the indicating module 13 in a main body of the mobile phone 10 further comprises a vibrating unit and a sound unit, which generate a vibration effect from a vibration function and a sound effect from a sound function respectively. The identification condition data C1 of the identification tag 201 are corresponding to two other reminder messages, such as a vibration reminder message and a sound reminder message. When the identification condition data C1 matches with or satisfies the predetermined reminder condition defined by the user, i.e., when the comparison result is a matching result, the vibration reminder message or the sound reminder message is being operated in conjunction with the image reminder message to reminder the user.

In another embodiment, an identification tag of a product is recorded with a tag identification code and an information reminder identification code. A user can download the tag identification code representing the product into the mobile phone 10 to set the foregoing predetermined reminder condition. Therefore, the user simultaneously stores and set the predetermined reminder condition and one or a plurality of reminder messages corresponding to the predetermined reminder condition into the memory 14 via the setting module 15. When the user passes by the product, the identification tag reader module 11 accesses the tag identification code of the identification tag, and compares the tag identification code with the predetermined reminder condition of the mobile phone using the processing module 12. When the tag identification code matches with the predetermined reminder condition, the indicating module 13 outputs the reminder message corresponding to the predetermined reminder condition to the mobile phone 10.

A reminder method corresponding to a tag of a product and a predetermined reminder condition of a user is provided according to the foregoing embodiment. However, in another embodiment, the predetermined reminder condition set by a user is a certain type of product, which is not limited to a specific brand or name. For example, when the user wishes to purchase a certain type of product, the product is not limited to a specific brand. In this embodiment, the user can set the predetermined reminder condition as a certain type, which can also be downloaded from information mediums provided by a store. The store or manufacturer defines and edits the identification condition information, of the type of product, comprising classification data of the type of product in addition to the particular identification data of the product. Accordingly, when the user gets close to the type of product, a variety of products belonging to the type matching with the predetermined reminder condition are available to the user. This method provides a more flexible information reminder function adaptive to a purchasing behavior of a user.

Moreover, the identification tag information reminder system 100 further comprises identification tags of other objects, and the user can set a plurality of predetermined reminder conditions with respect to different predetermined reminder tasks or events in the mobile phone 10. Referring to the identification tag format illustrated in FIG. 2 (*b*), a plurality of identification condition data and a plurality of predetermined reminder conditions are together stored and recorded in a same tag, which is accesses and identified to generate information reminders of a plurality of tasks or events. Taking the identification tag set by the user as an example, in addition to defining the locations of the private vehicle 21 or the house entrance 22 as the reminder conditions, a same tag having different reminder conditions can be provided by integrating time conditions. In this embodiment, the plurality of identification condition data corresponding to the predetermined reminder conditions and the reminder messages are together stored according to the capacity of the tag 211 and 212.

For instance, the content of a reminder is a predetermined time, or a moment such as before going out or driving to remind the user on a task to be done. A reminder method is similar to the foregoing embodiment. However, as far as this reminder is concerned, status information such as the date and the time of the mobile phone 10 is associated with set the predetermined reminder conditions and identification condition data. Furthermore, regardless that one group or various groups of information are stored in the tag, a complete scan is performed with respect to the content of the identification tag, and the information recorded in the tag is provided to the mobile phone one after another to generate corresponding reminder functions. However, the identification condition information or the plurality of predetermined reminder conditions may be repeatedly corresponding to the reminder messages or partial reminder functions, such as the vibration function and the sound function.

As mentioned above, the user further set the predetermined reminder conditions according to the status information of the mobile phone 10 or the information received by the mobile phone 10. For example, referring to FIG. 1, when the mobile phone 10 gets close to the power socket 23 having the identification tag 231, a reminder message is generated according to the power status of the mobile phone 10, so as to remind the user of charging the mobile phone 10. In another embodiment, the mobile phone 10 can receive the weather information. When the mobile phone 10 gets close to the house entrance 22 having the identification tag 221, a reminder message is generated according to the weather information, so as to remind the user to carry an umbrella, for example.

Figure 5:
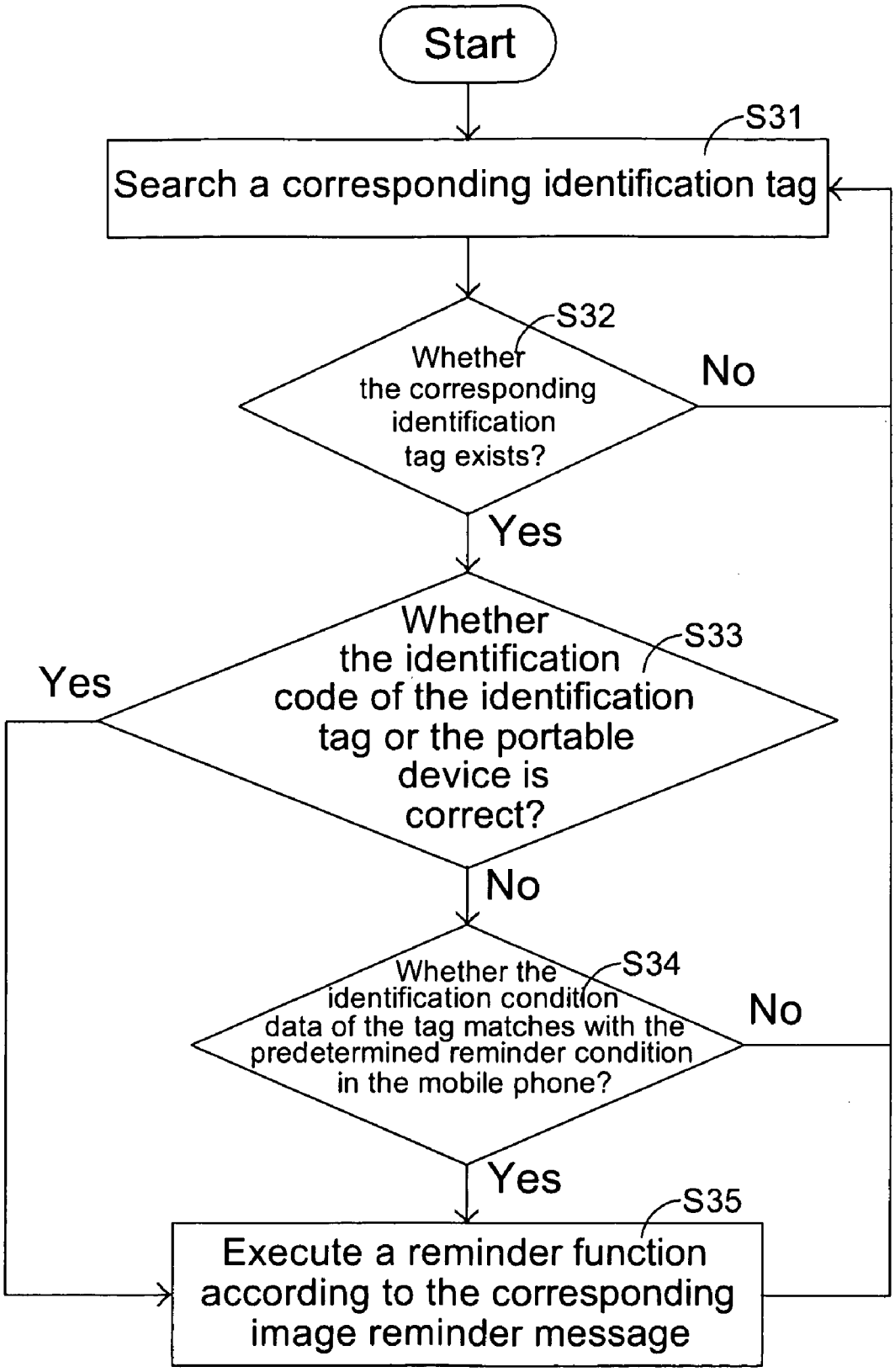
FIG. 5 is a flow chart of an operation of an identification tag information reminder method using the mobile phone 10 in accordance with another aspect of the present invention.

FIG. 5 is a flow chart of an operation in another embodiment. Steps of FIG. 5 and FIG. 4 are identical with an exception of an additional Step S33 in FIG. 5. In Step S33, the identification code of either the identification tag or the portable device is known, and is provided to the user to set the corresponding identification condition information and to perform a subsequent identification procedure.

For instance, One person set the identification tag 221 which is put at the house entrance 22 via his/her mobile phone 10, and the identification tag 221 is used to remind another person such as a child. Hence, the tag identification code of the identification tag 221 needs to be identified by a mobile phone used by the reminder person; that is, a predetermined reminder condition of the mobile phone of the reminder person is set as the tag identification code of the identification tag 221, or the identification condition data in the identification tag 221 is recorded as an identification code of the mobile phone used by the reminder person. When a mobile phone having the RFID function is near the house entrance 22, the corresponding reminder message recorded in the identification tag 221 is provided to the mobile phone according to the identification code of the mobile phone or the tag identification code of the identification tag 221. Therefore, setting and transmitting a reminder message or information to a portable device used by specific individuals is achieved via the method and the mechanism. In addition, a phone number in a form represents uniqueness, and hence the phone number may also be used for similarly providing the same reminder function and result according to the foregoing method and mechanism.

Figure 6A:
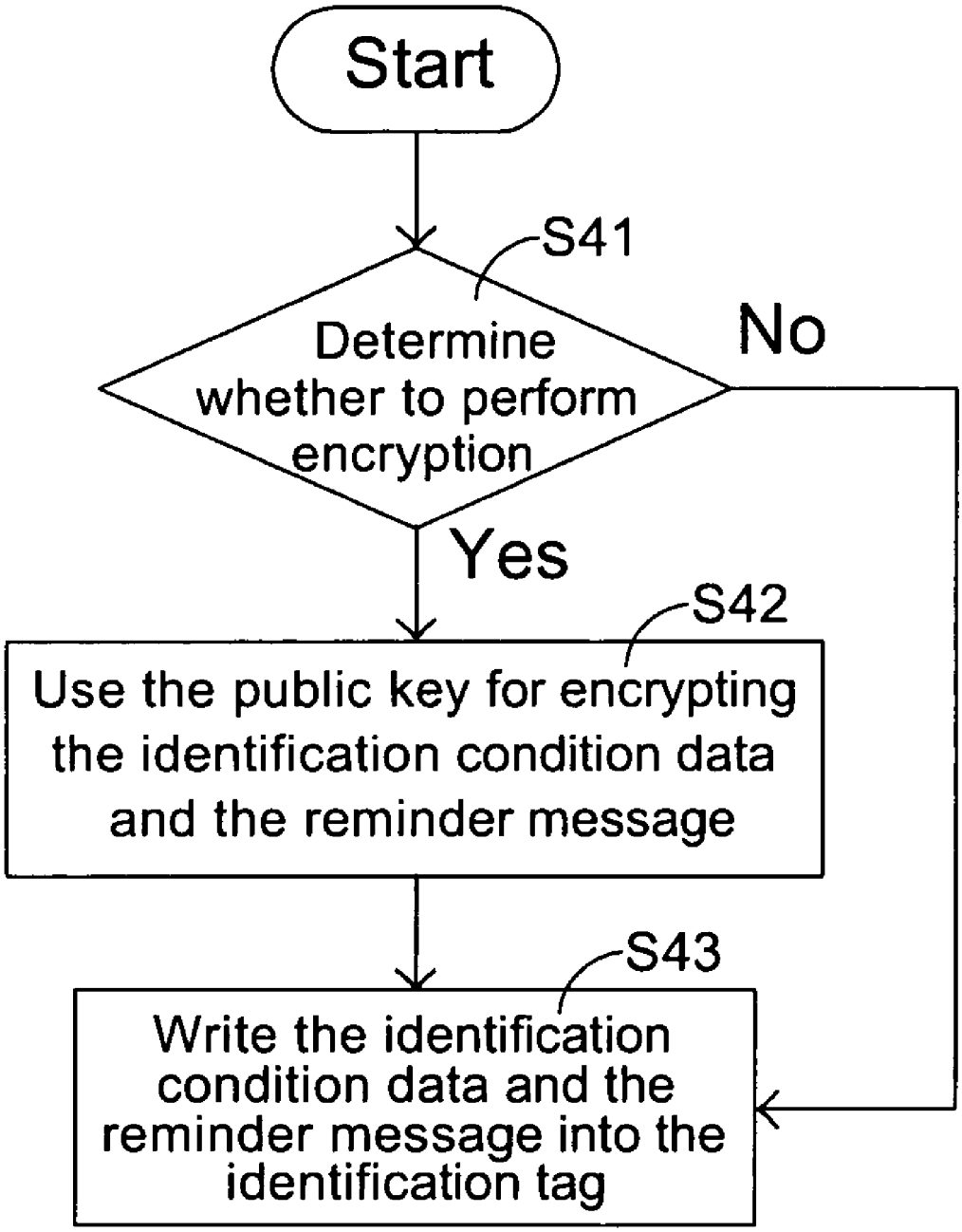
FIG. 6 (*a*) is a flow chart of encrypting an identification tag.
Figure 6B:
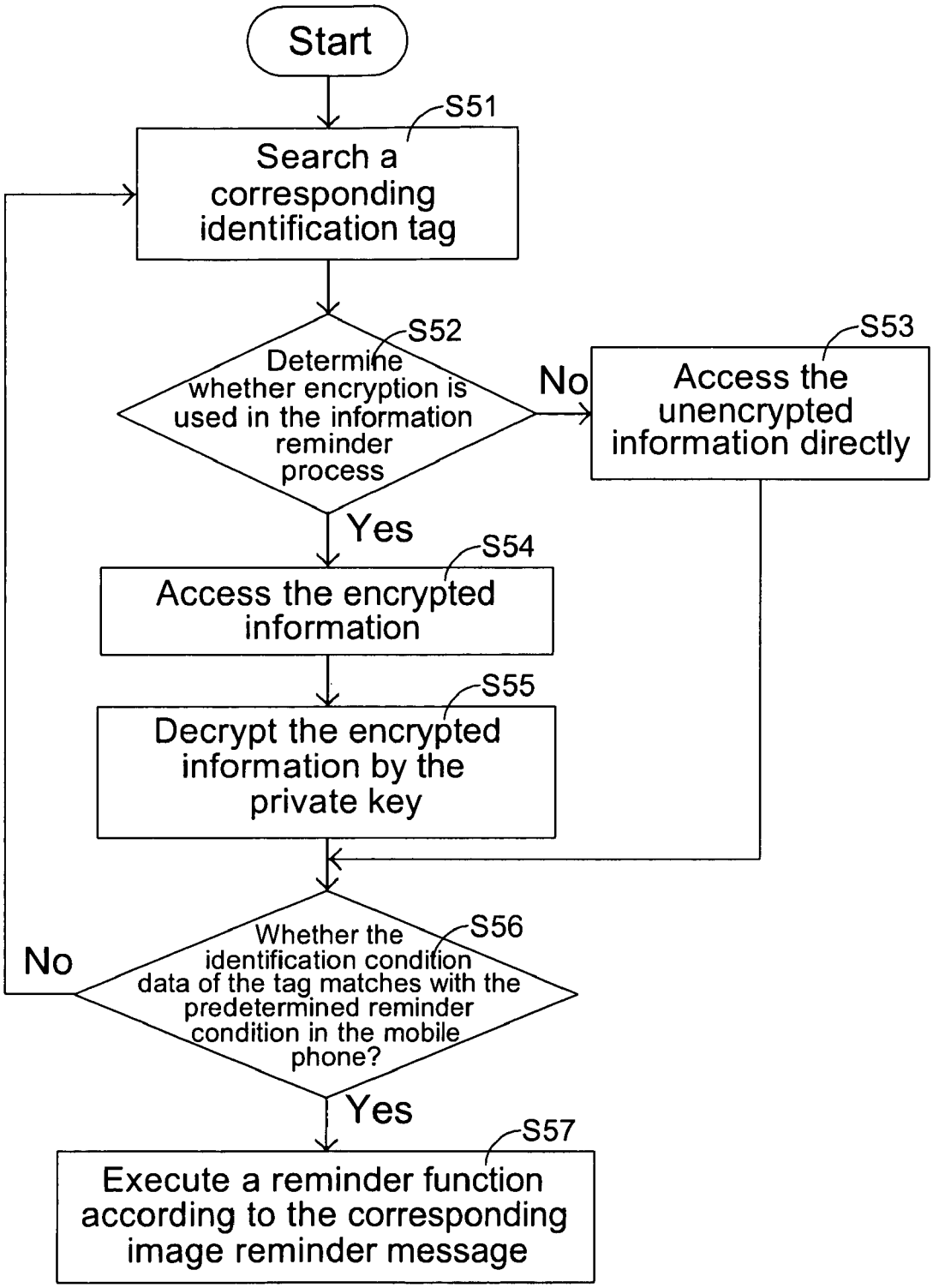

The identification tag may be used in an open space, such as the private vehicle 21 or the house entrance 22. Accordingly, when other mobile phones have a same RFID access identification function, reminder messages intended for private use may be exposed to other individuals. Therefore, according to another embodiment of the present invention, an appropriate encryption and decryption procedure is added to protect privacy of the reminder messages intended for private use. FIG. 6 (*a*) is a flow chart of encrypting an identification tag. FIG. 6 (*b*) is a flow chart of operating an encrypted identification tag via an identification tag information reminder method comprising a decryption process.

The flow in FIG. 6 (*a*) begins with Step S41. In Step S41, whether to perform encryption is determined. When encryption is not needed, Step S43 is executed. In Step S43, the reminder message is directly written and stored into the identification tag. Step S43 is the same as Step S14 in FIG. 3. When encryption is needed, an inquiry window of whether to perform encryption is displayed on the mobile phone 10 when storing the identification condition data and the corresponding reminder message into the identification tag according to a preferred embodiment. At this point, the foregoing encryption and decryption procedure implements a method of electronic certification, which provides a set of public key and private key to the user. In Step S42, the public key of the user is used for encrypting the identification condition data and the reminder message. The encrypted information is then written and stored into the identification tag.

The flow in FIG. 6 (*b*), in addition to the same steps as those in FIG. 4 and FIG. 5, further comprises the above-mentioned decryption process corresponding to the encryption process. In Step S51, a corresponding RFID identification tag is scanned by the mobile phone 10. In Step S52, whether encryption is used in an information reminder process is determined. In Step S53, when encryption is not used, the unencrypted information of the identification tag is directly accessed. In Step S56, the identification condition data of the identification tag is determined. In Step S57, the reminder message is accessed to operate a corresponding reminder function. Step S56 and Step S57 are respectively the same as Step S23 and Step S24. When encryption is added, Step S54 and Step S55 are performed. In Step S54, the encrypted information by the mobile phone 10 is accessed. In Step S55, the encrypted information is decrypted by the private key of the user.

As mentioned above, not only the public key of the mobile phone 10 applied during encryption, but also the private key corresponding to the public key is unique. Therefore, the information is correctly decrypted only when the mobile phone 10 of the same user is used for accessing the information. Otherwise, the information is not correctly decrypted even if the information can be downloaded, and the information indicated or displayed on the mobile phone or the reminder message shall appear as corrupted codes. Accordingly, privacy of the private reminder message of the private tag provided at the open space is protected. In addition, the determinant after decryption and operations of the reminder function are the same as those in the foregoing flow and are not unnecessarily further described.

In conclusion, an information reminder function needed by a user is effectively achieved according to a system and a method thereof of the present invention. Apart from accomplishing a conventional reminder function of reservation or timing using the time of an electronic device or a portable device, versatility in application and operation as well as adaption to customized product are provided according to the present invention, to further explore capabilities of the RFID technology. Therefore, the main objective of the invention is successfully achieved.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. An identification tag information reminder system, comprising:

an identification tag, for storing a tag identification code, an identification condition data and a reminder message corresponding to the identification condition data; and a portable device, comprising:

a memory, for storing a plurality of predetermined reminder conditions;

an identification tag access module, for accessing the tag identification code, the identification condition data, and the reminder message corresponding to the identification condition data of the identification tag;

a processing module, for comparing the plurality of the predetermined reminder conditions with the tag identification code and the identification condition data to generate a comparison result; and an indicating module, for outputting the reminder message according to the comparison result.

2. The identification tag information reminder system as claimed in claim 1, wherein the indicating module comprises a vibrating unit for generating a vibration effect when the comparison result is a matching result.

3. The identification tag information reminder system as claimed in claim 1, wherein the indicating module comprises a sound unit for generating a sound effect when the comparison result is a matching result.

4. The identification tag information reminder system as claimed in claim 1, wherein the portable device comprises a setting module for setting the plurality of the predetermined reminder conditions.

5. The identification tag information reminder system as claimed in claim 1, wherein the portable device comprises a setting module for setting the identification condition data.

6. An identification tag information reminder method, applied to an identification tag information reminder system comprising a portable device and an identification tag, wherein the identification tag stores a tag identification code, an identification condition data, and a reminder message corresponding to the identification condition data, the identification tag information reminder method comprising:

setting a predetermined reminder condition into the portable device;

accessing the tag identification code, the identification condition data and the reminder message corresponding to the identification condition data of the identification tag;

comparing the tag identification code and the identification condition data with the predetermined reminder condition to generate a comparison result; and outputting the reminder message according to the comparison result.

7. The identification tag information reminder method as claimed in claim 6, further comprising:

setting the identification condition data and the reminder message corresponding to the identification condition data of the identification tag.

8. The identification tag information reminder method as claimed in claim 7, wherein the step of setting the identification condition data and the reminder message corresponding to the identification condition data of the identification tag comprises encrypting the identification condition data and the reminder message corresponding to the identification condition data of the identification tag.

9. A portable identification tag information reminder device, for accessing an identification tag, comprising:

a memory, for storing a predetermined reminder condition and a reminder message corresponding to the predetermined reminder condition;

an identification tag access module, for accessing a tag identification code of the identification tag;

a processing module, for comparing the tag identification code with the predetermined reminder condition to generate a comparison result; and an indicating module, for outputting the reminder message according to the comparison result.

10. The portable identification tag information reminder device as claimed in claim 9, wherein the indicating module comprises a vibrating unit generating a vibration effect when the comparison result is a matching result.

11. The portable identification tag information reminder device as claimed in claim 9, wherein the indicating module comprises a sound unit generating a sound effect when the comparison result is a matching result.

12. The portable identification tag information reminder device as claimed in claim 9, comprising a setting module for setting the predetermined reminder condition.

13. A portable identification tag information reminder device, accessing an identification tag, comprising:

a memory, for storing a predetermined reminder condition;

an identification tag access module, for accessing a tag identification code, a identification condition data, and a reminder message corresponding to the identification condition data of the identification tag;

a processing module, for comparing the tag identification code and the identification condition data with the predetermined reminder condition to generate a comparison result; and an indicating module, for outputting the reminder message according to the comparison result.

14. The portable identification tag information reminder device as claimed in claim 13, wherein the device comprises a setting module for setting content of the identification tag, and the content comprises the identification condition data and the reminder message.

* * * * *